United States Patent [19]

Kurafuji

[11] Patent Number: 5,008,684

[45] Date of Patent: Apr. 16, 1991

[54] HEAD DRIVING APPARATUS FOR THERMAL PRINTER

[75] Inventor: Hiroshi Kurafuji, Tokyo, Japan

[73] Assignee: Citizen Watch Co., Ltd., Tokyo, Japan

[21] Appl. No.: 506,854

[22] Filed: Apr. 9, 1990

[30] Foreign Application Priority Data

Apr. 12, 1989 [JP] Japan ..... 1-92061

[51] Int. Cl.[5] ..... B41J 2/32

[52] U.S. Cl. ..... 346/76 PH; 400/185; 400/320; 400/356

[58] Field of Search ..... 346/76 PH, 134, 136; 400/185, 120 HE, 320, 356

[56] References Cited

U.S. PATENT DOCUMENTS

| | | | |
|---|---|---|---|
| 4,444,521 | 4/1984 | Rickard et al. | 400/185 |
| 4,643,602 | 2/1987 | Ikeda et al. | 400/320 |
| 4,752,786 | 6/1988 | Inoue et al. | 400/185 |
| 4,920,258 | 4/1990 | Saito | 400/185 |
| 4,952,084 | 8/1990 | Maruyama | 400/185 |

FOREIGN PATENT DOCUMENTS

| | | | |
|---|---|---|---|
| 0149470 | 7/1987 | Japan | 400/120 HE |

*Primary Examiner*—George H. Miller, Jr.
*Assistant Examiner*—Nancy Le
*Attorney, Agent, or Firm*—Koda and Androlia

[57] ABSTRACT

In a thermal printer, a driving apparatus moves a thermal head both longitudinally of and perpendicularly toward and away from a platen. A racing or idle rotating of gears is utilized in a driving mechanism for reciprocatingly moving a carriage carrying the head. Further, sector gears are used in a loading mechanism for moving the head toward and away from the platen. By combining these two unique structures, the rotational force of a drive motor is converted into the driving force to move the head toward and away from the platen when the carriage is switched between its forward movement and its backward movement. The result is that the carriage driving mechanism and the head load mechanism are operated by the common drive motor.

4 Claims, 6 Drawing Sheets

HEAD DRIVING APPARATUS FOR THERMAL PRINTER

BACKGROUND OF THE INVENTION

1. Field of the Invention

This invention relates to a head driving apparatus for a thermal printer, and more particularly to a driving apparatus for moving a thermal head either longitudinally of a platen or perpendicularly toward and away from the platen in a thermal printer.

2. Description of the Related Art

Heretofore, thermal printers in which characters are printed on a thermosensitive paper by forcing the thermosensitive paper against a platen by a thermal head are popular as a recording means for process control and a character information output means for a microcomputer. Since a thermosensitive paper has the color forming feature, the conventional thermal printers can be small-sized and hence inexpensive.

For the printing action of the thermal printer, the thermal head is pressed against a thermosensitive paper on the platen in response to a command from a control unit, whereupon a carriage supporting the thermal head is moved horizontally on a guide rail parallel to the platen.

Upon termination of printing, the thermal head is brought away from the thermosensitive paper by a drive mean, and with the thermal head in this posture, the carriage is returned to its original or starting position at high speed. This cycle of procedures is repeated.

In this type of thermal printer, the thermal head is supported directly by a slider disposed in the carriage. The slider is slidably mounted on the carriage for movement perpendicularly toward and away from the platen.

The carriage is slidably held on a support shaft parallel to the guide rail is movable on the support shaft longitudinally of the platen. The movement of the thermal head toward and away from the thermosensitive paper on the platen, at the end of either forward or backward stroke of the carriage during printing, is accomplished by turning the support shaft in forward and reverse directions through a predetermined angle about its own axis.

In such a head driving apparatus of the conventional thermal printer, the head is in contact with the thermosensitive paper on the platen during the forward movement of the carriage. The head is moved away from the platen at the end of the forward movement, i.e., upon completion of each printing action on the corresponding line, whereupon the carriage is returned to its original position at a speed higher than that during the forward movement and then restarts its forward movement from the original position to print the next line. This procedure is repeated as many times as there are the succeeding lines.

With this driving arrangement, since the speed of returning the carriage during the backward movement, in which no substantial printing action is performed, is increased, it is possible to improve the efficiency of printing by some degree.

However, this conventional printing method requires two kinds of separately controlled drives for the longitudinal movement of the thermal head forwardly and backwardly along the platen and the perpendicular movement of the head toward and away from the platen. Consequently, two separate drive motors must be used for driving the head in the two different directions perpendicular to one another; this makes the head driving mechanism rather complex and large-sized so that a raise of cost of production cannot be avoided.

At the start of the forward stroke of the carriage, the support shaft of the carriage is turned through a predetermined angle toward the platen to allow the slider to move toward the platen under the bias of the spring, thereby bringing the thermal head into contact with the thermosensitive paper. At the termination of the line printing, the support shaft is turned reversely to move the slider away from the platen against the bias of the spring, thereby bringing the head out of contact with the thermosensitive paper.

Accordingly, during the forward and backward movement of the carriage after the angular movement of the head toward and away from the platen, the spring-biased slider and a pawl mechanism are balanced.

As a result, during the forward and backward movement of the carriage, the biasing force of the spring urging the slider is unnecessary exerted on the support shaft via the pawl mechanism, which would occasionally be a cause for a raise of consumed electricity, a reduced life of the parts, noise, a fault or other trouble.

SUMMARY OF THE INVENTION

It is therefore an object of this invention to provide a head driving apparatus, for a thermal printer, in which a thermal head can be driven either longitudinally of a platen or perpendicularly toward and away from the platen, without any unnecessary load exerted on a support shaft of a head carriage during printing.

According to a first aspect of this invention, there is provided an apparatus for driving a thermal head in a thermal printer, comprising: a carriage for supporting the thermal head in confronting relation to a platen on which a print paper is to be supported, the carriage being movable in a forward direction along a longitudinal path parallel to the axis of the platen, with the thermal head pressed against the platen via an ink ribbon and the print paper, during forward movement for printing, and the carriage being movable in a backward direction along the longitudinal path to return to its original position, with the thermal head off the platen, during returning; a support shaft for supporting thereon the carriage in such a manner that the carriage is slidable along the support shaft longitudinally thereof; a carriage driving mechanism for driving the carriage to move on and along the support shaft in the forward and backward directions, the carriage driving mechanism including a drive motor rotatable forwardly and reversely corresponding to the forward and backward movements of the carriage, a reduction gear train operatively connected to a driving shaft of the drive motor, and a carriage feed wheel, the carriage feed wheel being composed of a lower gear having a engaging pawl and meshable with the reduction gear train for performing the forward and backward movements of the carriage, and an upper gear having a play groove engageable with the engaging pawl of the lower gear, the upper gear being pivotable coaxially of the lower gear, the upper gear being rotatable as a unit with the lower gear, with the engaging pawl being in engagement with one of opposite ends of the play groove during the forward movement and the returning of the carriage; and a head loading mechanism for bringing the thermal head into and out of the platen at respective ends of the forward and backward movements of the carriage, the head loading mechanism including a pulley operatively connected to the support shaft of the carriage driving mechanism by a belt, upper and lower sector wheels each having a tooth-free portion and a toothed portion and coaxially connected to the pulley, a carriage driving idle wheel normally meshing with the lower gear of the carriage feed wheel, and upper and lower idle gears locatable in confronting relation to the respective tooth-free portions of the upper and lower sector wheels for idle rotation during the forward and backward movements of the carriage, the upper and lower idle gears being meshable with the respective toothed portions of the upper and lower sector wheels for angular movement through a predetermined angle while the engaging pawl of the lower gear slides in and along the play groove of the upper gear as the drive motor is rotated reversely when the carriage is switched over between the forward movement and the backward movement, whereby the support shaft of the carriage is angularly moved through the predetermined angle, in response to the angular movement of the upper and lower sector wheels, to bring the thermal head into and out of engagement with the print paper on the platen.

According to a second aspect of the invention, the head loading mechanism further includes: a slider slidably mounted on the carriage so as to be movable perpendicularly to the sliding direction of the carriage for controlling the angular movement of the thermal head toward and away from the platen; a first spring normally urging the slider toward the platen; a driving pawl attached to the support shaft and slidable, with the carriage, longitudinally on the support shaft and angularly movable as a unit with the support shaft, the driving pawl being operable to move the slider away from the platen against the bias of the first spring as the support shaft is driven to rotate when the carriage is switched from the forward movement to the backward movement, and the driving pawl being also operable to allow the slider to move toward the platen under the bias of the first spring as the support shaft is driven to rotate when the carriage is switched from the backward movement to the forward movement; a locking pawl pivotally mounted on the carriage and normally urged by a second spring to pivotally move in one direction, the locking pawl being operable to move into the driving pawl and the slider to hold the slider in a predetermined position away from the platen against the bias of the first spring as the slider is moved away from the platen to a predetermined extent by the driving pawl when the carriage is switched from the forward movement to the backward movement, and the locking pawl being operable to allow the slider to be released from the predetermined position by the driving pawl; and a cam mechanism operatively connected to the pulley for angularly moving the support shaft through a predetermined angle in opposite directions.

With the first arrangement of this invention, during the reverse rotation of the drive motor at the end of either the forward or the backward stroke of the carriage, the longitudinal movement of the carriage is idled by converting the rotational force of the drive motor into the moving force to bring the thermal head perpendicularly toward and away from the platen.

Specifically, during the reverse rotation of the drive motor, the engaging pawl of the driving lower gear moves idly in the play groove of the upper gear from one end toward the other. During that time, the upper gear for moving the carriage longitudinally of the platen is kept free from rotation so that the gear train meshing with the upper gear is kept inoperative.

During the idle movement of the engaging pawl, the upper or the lower idle gear meshes the corresponding upper or lower sector wheel via the carriage driving idle wheel normally meshing with the lower gear, and the toothed portion of that sector wheel is in meshing engagement with the corresponding idle gear so that the support of the carriage driving mechanism is rotated via the pulley.

Therefore, when the carriage is moved longitudinally of the platen, the head loading mechanism is kept substantially inoperative, but only the carriage driving mechanism is kept operative. And only when the drive motor is rotated reversely at the end of either the forward or backward stroke of the carriage, the head loading mechanism is operated so that the thermal head is moved toward and away the platen by the rotational force of the common motor.

With the second arrangement of the invention, when the support shaft is turned about its own shaft by the cam mechanism at the end of either the forward or backward stroke of the carriage, the driving pawl rotatable as a unit with the support shaft causes the slider to move away from the platen against the bias of the spring so that the thermal head supported by the slider is brought out of contact with the print paper.

Concurrently with this movement of the slider, the locking pawl angularly movably supported by the carriage enters between the driving pawl and the slider to receive the biasing force of the spring.

The driving pawl and the support shaft of the carriage are released from the biasing force of the slider after the thermal head is moved away from the platen. Thus it can be readily prepared to perform the subsequent longitudinal movement of the carriage without receiving any unnecessary load.

The above and other advantages, features and additional objects of this invention will be manifest to those versed in the art upon making reference to the following detailed description and the accompanying drawings in which two preferred structural embodiments incorporating the principles of this invention are shown by way of illustrative example.

DETAILED DESCRIPTION

The principles of this invention are particularly useful when embodied in a head driving apparatus, for a thermal printer, such as shown in FIG. I.

Figure 1:
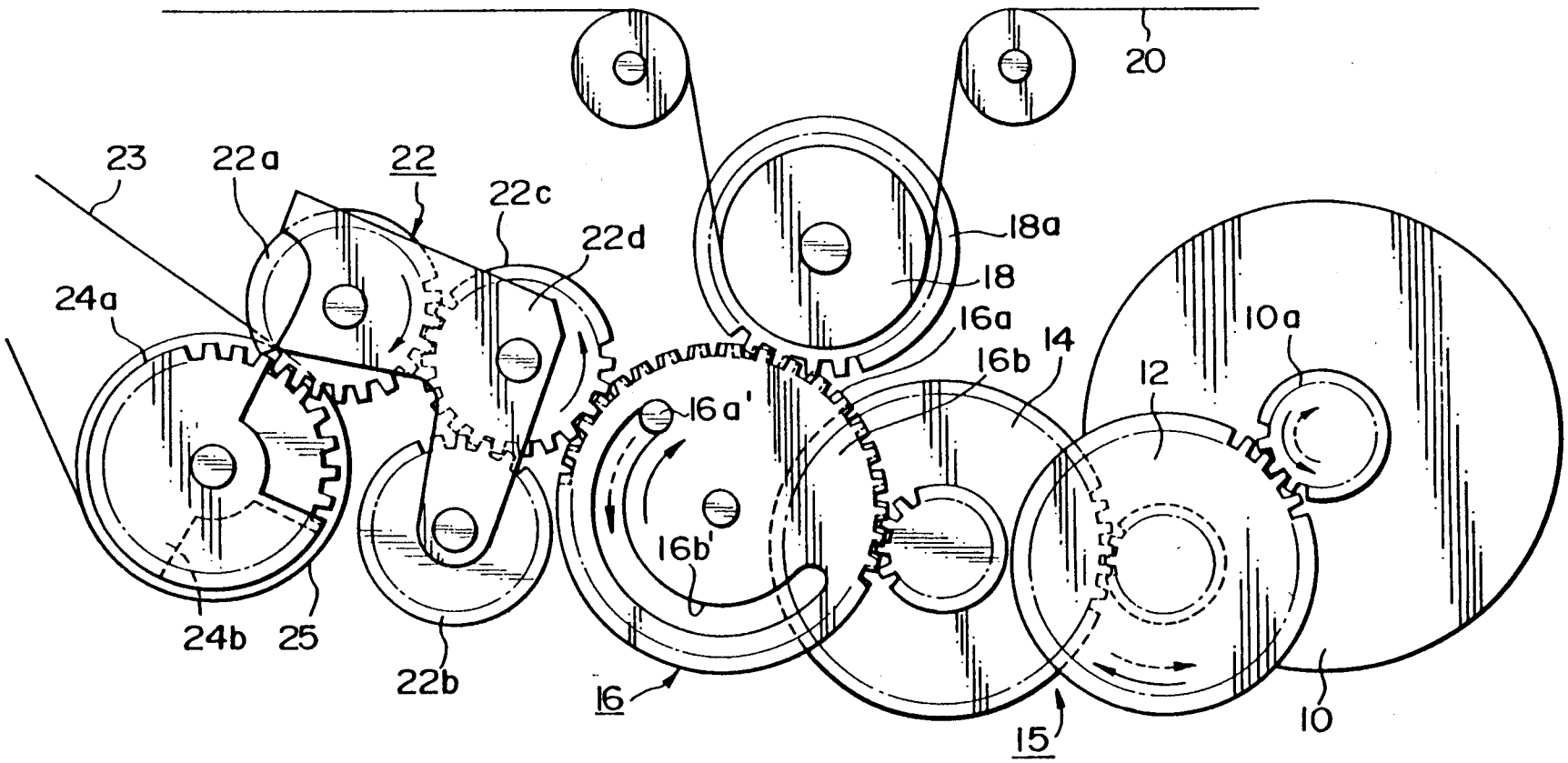
FIG. 1 is a side elevational view of a head driving apparatus, for a thermal printer, according to a first embodiment of this invention.

In FIG. 1, a pinion 10*a* of a drive motor 10, for forward and reverse rotations corresponding to forward and backward movements of a non-illustrated carriage, is in meshing engagement with a reduction gear train 15 which is composed of first and second reduction gears 12, 14. The second gear 14 is in meshing engagement with a carriage feed wheel 16, via which the rotation of the drive motor 10 is transmitted to a carriage feed pulley 18. The carriage slides on a non-illustrated guide rail, parallel to a platen of the thermal printer, as the carriage receives this driving force via a carriage feed belt 20 wound on the pulley 18.

These foregoing components jointly constitute a carriage driving mechanism for moving the carriage, with a thermal head pressed against the platen, forwardly along the print paper during printing, and for returning the carriage, with the thermal head out of contact with the platen, to the original position after completion of printing of each line.

Conventionally, in moving the thermal head toward and away from the platen at the end of either the forward or the backward stroke, two separate drive motors are needed for exclusive purposes, i.e., to drive the carriage longitudinally of the platen and to move the thermal head perpendicularly toward and away from the platen. Thus the longitudinal movement and the perpendicular movement, of the thermal head, are achieved by the two independent driving systems. For this reason, the conventional apparatus is inevitably large-sized and hence expensive to manufacture.

For the significant feature of this invention, the rotational force of the only drive motor, which had conventionally been used only for reciprocating movement of the carriage, is utilized also in moving the thermal head perpendicularly toward and away from the platen. For this purpose, a head loading mechanism is operatively connected with the carriage driving mechanism.

In the illustrated embodiment, the head loading mechanism includes an idling mechanism 22 having upper and lower idle gears **22*a*, 22*b* and meshing the carriage feed wheel 16, and upper and lower sector wheels 24*a*, 24*b* respectively meshable with the upper and lower idle gears 21*a*, 22*b*. The upper and lower sector wheels 24*a*, 24*b* are coaxially connected to a pulley 25 which drives a support shaft of the carriage via an endless belt 23**.

The carriage feed wheel 16 is composed of coaxially pivoted lower and upper gears **16*a*, 16*b* which are mutually independently rotatable. The upper gear 16*b*, normally meshing the second reduction gear 14 and a pulley drive gear 18*a* of the carriage feed pulley 18, has a generally C-shaped play groove 16*b*'**.

On the lower gear **16*a*, a engaging pawl 16*a*' is mounted which is slidable in and along the play groove 16*b*' of the upper gear 16*b* with friction. This lower gear 16*a* serves to assist in moving the thermal head perpendicularly toward and away from the platen, and is normally in meshing engagement with a carriage driving idle gear 22*c* of the idling mechanism 22**.

The mode of operation of the apparatus will now be described during printing, during which time the thermal head slides in contact with the platen.

At that time, the pinion **10*a* and the reduction gear train 15 are rotated in the respective directions of solid-line arrows, and the carriage feed wheel 16 is rotated clockwise with the locking pawl 16*a* of the lower gear 16*a* being engaged in the end of the play groove 16*b*' of the upper gear 16*b*. The carriage feed pulley 18 is thereby rotated to move the carriage, which is fixed to the carriage feed belt 20**, in the direction of printing.

The printing direction of this carriage may be set optionally.

Since the carriage driving idle gear **22*c* of the idling mechanism 22 is normally in meshing engagement with the lower gear 16*a* of the carriage feed wheel 16, the carriage driving idle gear 22*c* continues rotating counterclockwise when the lower gear 16*a*** is rotated clockwise.

At that time, an idle-gear support plate **22*d* of the idling mechanism 22 receives rotating action in the counterclockwise due to the sliding friction so that the upper idle gear 22*a* comes in meshing engagement with the upper sector wheel 24*a*** to rotate clockwise.

However, even with its continued rotation, the upper idle gear **22*a* confronts the tooth-free portion of the upper sector wheel 24*a*. The upper sector gear 24*a* does not receive a substantial rotational drive, only intermittently contacting the upper idle gear 22*a*** with click-clack, so that the length of perpendicular stroke of the thermal head does not vary and continues printing.

Subsequently, upon completion of printing at the end of forward movement of the carriage, the drive motor 10 rotates reversely for backward movement of the carriage. Therefore the pinion **10*a* of the motor 10 and the reduction gear train 15 starts rotating reversely in the respective directions of dotted-line arrows so that the lower gear 16*a* of the carriage feed wheel 16, meshing with the second reduction gear 14, is rotated counterclockwise in FIG. 1**.

Now, since the engaging pawl **16*a*' of the lower gear 16*a* runs idly in the play groove 16*b*' of the upper gear 16*b*, the upper and lower gears 16*b*, 16*a* are released from their initial unitary rotating condition so that with the upper gear 16*b* being kept stationary, only the lower gear 16*a* is rotated until the engaging pawl 16*a*' reaches the lower end of the play groove 16*b*'**.

Accordingly, a pulley drive gear **18*a* is kept stationary during the idle running of the engaging pawl 16*a*', the carriage does not slide even though the drive motor 10** is in rotation.

This invention utilizes the duration in which the engaging pawl **16*a*' of the lower gear 16*a* of the carriage feed wheel 16 runs idly in the play groove 16*b*' of the upper gear 16*b*** to enable the thermal head to move perpendicularly toward and away from the platen.

The perpendicular movement of the thermal head will now be described in greater detail. When the engaging pawl **16*a* of the lower gear 16*a* of the carriage feed wheel 16 runs idly in the play groove 16*b*' of the upper gear 16*b* as the lower gear 16*a* is rotated counterclockwise by the reverse rotation of the drive motor 10, the carriage driving idle gear 22*c*** also is reversely rotated and is hence converted into clockwise rotation.

Specifically, since the idle-gear support plate **22*d* of the idling mechanism 22 is turned then clockwise through a predetermined angle due to the sliding friction, the lower idle gear 22*d* comes in engagement with the corresponding lower sector wheel 24*b***.

Figure 2:
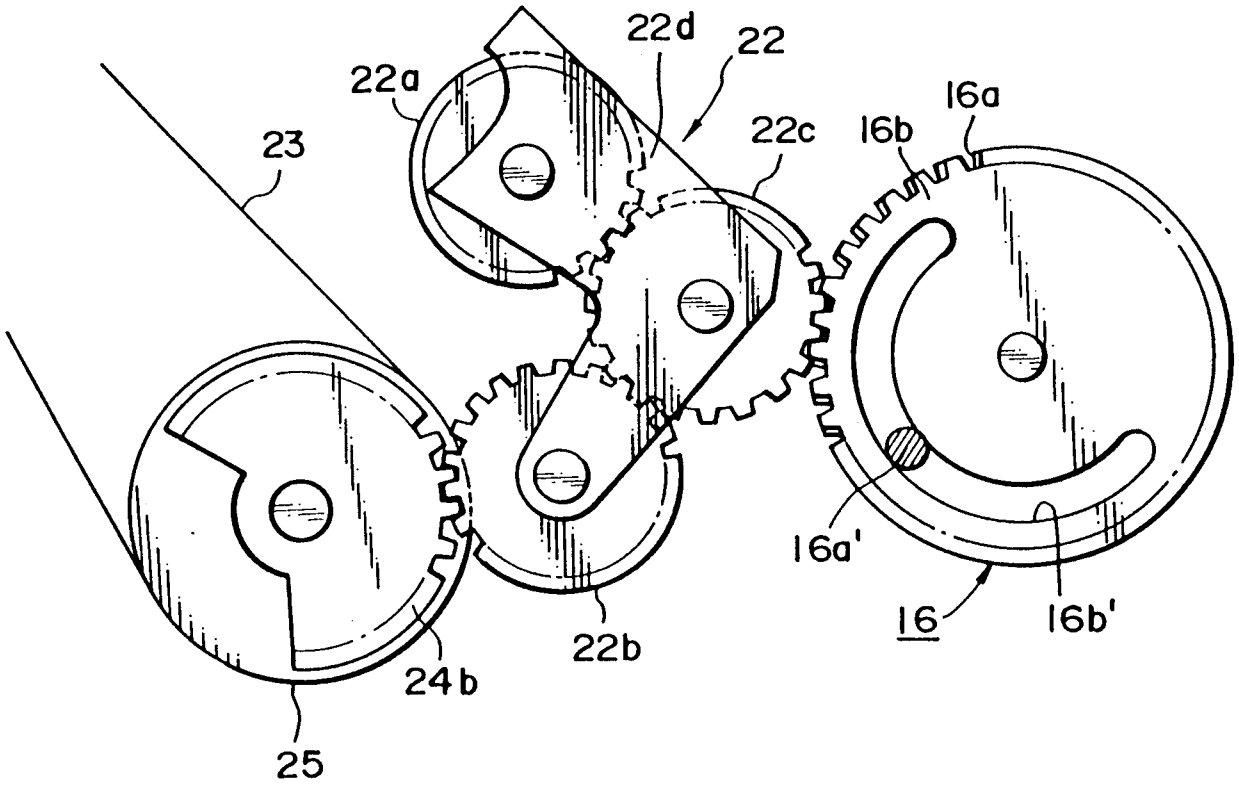
FIG. 2 is a side elevational view of a carriage feed wheel, an idling mechanism and sector wheels of the apparatus of FIG. 1, illustrating its mode of operation.

At that time, as the lower idle gear **22*b* is rotated counterclockwise, the confronting portion of the lower sector wheel 24*b* is not the tooth-free portion but the toothed portion. Therefore, since the lower sector wheel 24*b* is rotated clockwise in FIG. 2 until the meshed position of the lower sector wheel 24*b* with the lower idle gear 22*b*** reaches the other end of the toothed portion, the support shaft of the carriage is turned about its own axis through a predetermined angle via the pulley and the belt, thus bringing the thermal head away from the platen.

The length of toothed portion (amount of rotation) of the lower sector wheel 24b is set to be equal to the distance by which the engaging pawl 16a' of the lower gear 16a of the carriage feed wheel 16 runs idly in the play groove 16b' of the upper gear 16b.

Upon arrival of the engaging pawl 16a' at the other end of the play groove 16b', the upper gear restart rotating as a unit with the lower gear 16a to accomplish the sliding of the carriage, in this case the returning to the original position for subsequent printing.

Reversely to the forward movement, during the returning, the lower idle gear 22b of the head loading mechanism is located in confronting relation to the tooth-free portion of the lower sector wheel 24b so that both the lower idle gear 22b and the corresponding lower sector wheel 24b run idly according to the principles discussed above. As a result, the support shaft of the carriage does not receive any rotational drive.

With this arrangement, since the feeding of the carriage is stopped for a predetermined period of time at the end of either the forward or the backward stroke of the carriage to convert the rotating force of the drive motor 10 into the rotating force of the support shaft of the carriage via the head loading mechanism, it is possible to realize that both the longitudinal driving of the carriage and the perpendicular movement of the thermal head toward and away from the platen are conducted by one and the same drive motor 10. It is accordingly possible to reduce the size of the apparatus, the cost of production and the amount of consumed electrical energy effectively with impairing any function of the apparatus.

In the illustrated embodiment, the thermal head is brought away from the platen by turning the support shaft of the carriage against the bias of the spring and, at the same time, the support shaft is released from this biasing force so that no unnecessary load acts on the support shaft when the carriage is returned longitudinally of the platen to the printing start point.

Figure 3A:
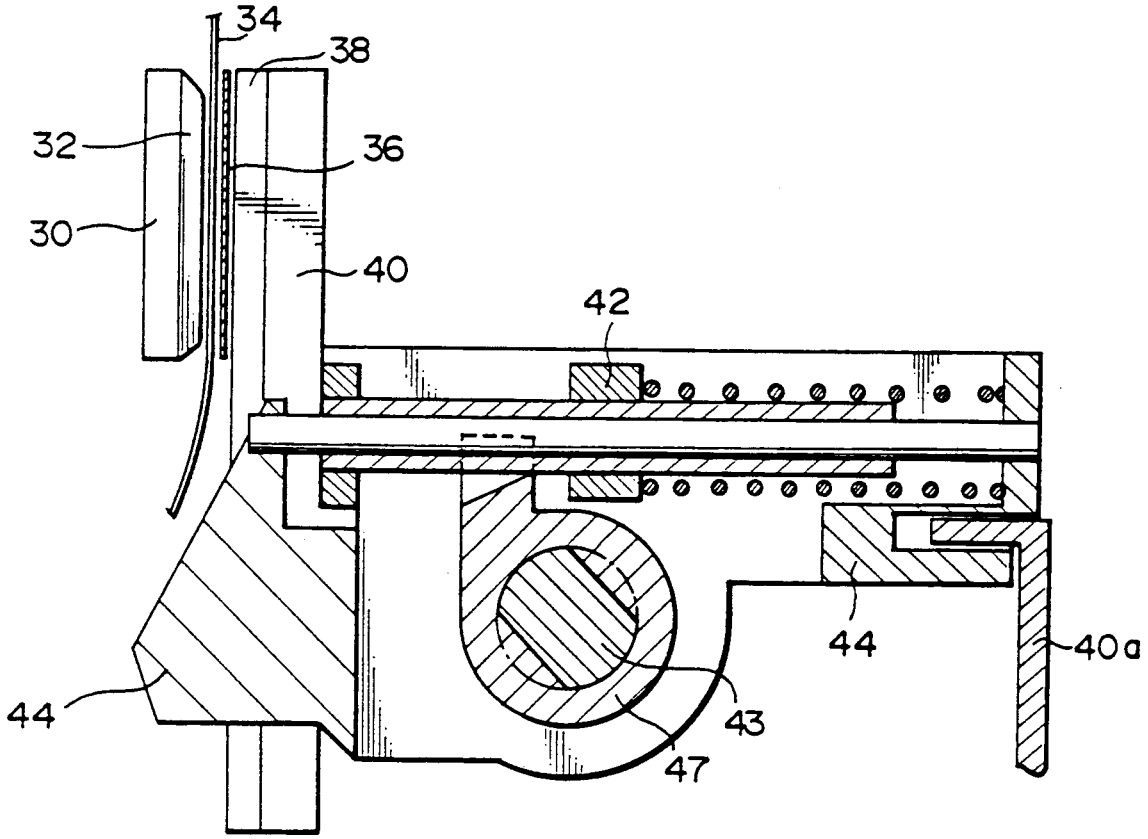
FIG. 3(A) is a vertical cross-sectional view of a modified apparatus according to a second embodiment.
Figure 3B:
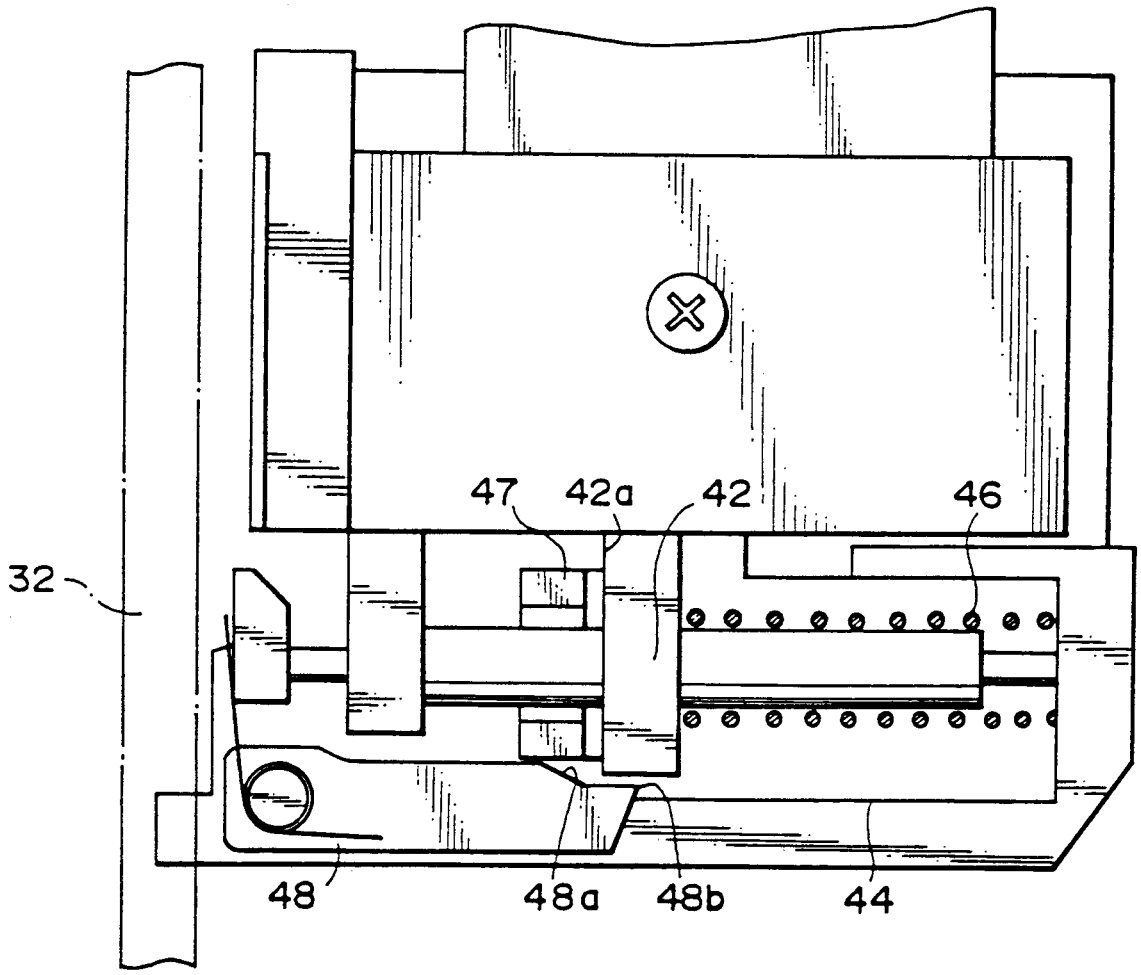
FIG. 3(B) is a plan view of FIG. 3(A)

FIGS. 3(A) and 3(B) show a carriage and its associated parts of a thermal printer in which a modified apparatus according to a second embodiment is incorporated.

As shown in FIG. 3(A), a thermal head 38 is fixed to a thermal head holder 40 and confronts a platen 32 via a print paper 34 and an ink ribbon 36, the platen 32 being held by a platen holder 30. The thermal head holder 40 is fixedly connected to a slider 42 which is slidable on a carriage 44 toward and away from the platen in a manner described below. The carriage 44 is slidable on a guide rail 40a supported by a non-illustrated frame in parallel relation to the platen 32. The slider 42 is normally urged toward the platen 32 by a compressing spring 46 acting between the slider 42 and the carriage 44.

In FIG. 3(B), a locking pawl 48 is pivotally attached to carriage 44 and is normally urged counterclockwise by an unnumbered torsion spring for restricting the horizontal sliding movement of the slider 42 to be caused by the spring 46.

FIG. 3(B) shows the thermal head 38 in contact with the print paper on the platen 32. A driving pawl 47, which is slidable leftwardly under the biasing force of the spring 46, runs on a slope 48a adjacent to the distal end of the locking pawl 48 to prevent the locking pawl 48 from entering between the slider 42 and the driving pawl 47, thereby allowing the slider 42 to move toward the platen under the biasing force of the spring 46. As a result, the thermal head 38 is kept in contact with the platen.

The mode of operation of the apparatus according to the second embodiment will now be described.

The description starts with the operation when the thermal head 38 is moved away from the platen 32 upon completion of the forward stroke of the carriage 38.

At the end of the forward stroke of the carriage 44, the support shaft 43 is turned about its own axis through a predetermined angle by the non-illustrated head loading mechanism.

As shown in FIG. 3(A), the driving pawl 47 is attached to the support shaft 43 for engagement with the slider 42 and is slidable along the support shaft 43 and turnable as a unit therewith.

Figure 4:
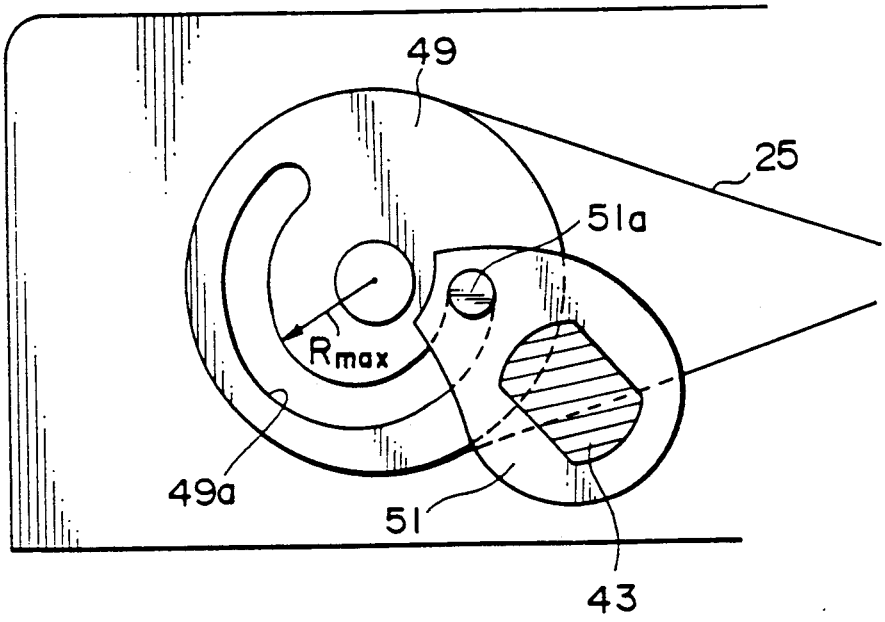
FIG. 4 is a detail view of a cam mechanism of the modified apparatus.
Figure 5:
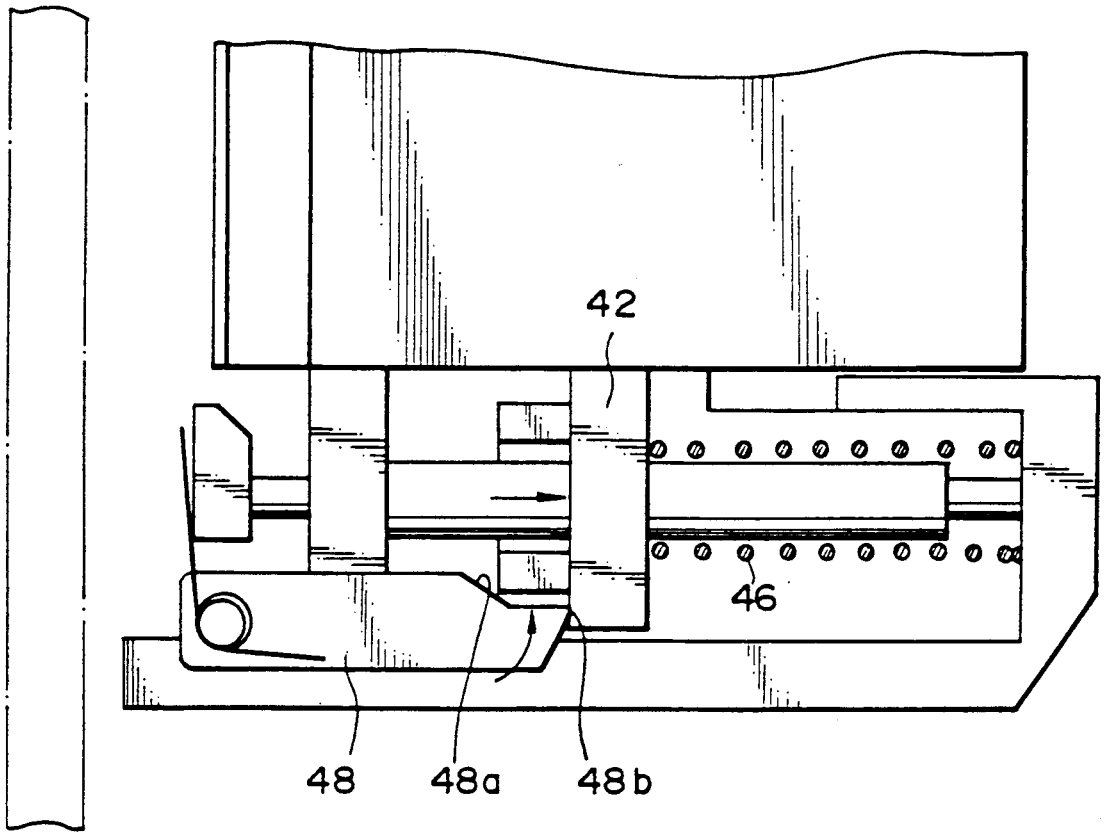
FIG. 5 is a view similar to FIG. 3(B), illustrating a locking pawl in engagement with a slider to release the slider from a driving pawl.

Meanwhile, as shown in FIG. 4, a pin 51a of a cam follower 51 attached to the support shaft 43 is rotatably mounted on a cam disk 49 operatively connected to the non-illustrated head loading mechanism via the belt 23. The cam disk 49 has a generally C-shaped eccentric cam groove 49a. The eccentric cam groove 49a has a first portion and a second portion continuous with the first portion at a peak point where the distance between the cam groove 49a and the axis of rotation of the cam disk 49 is maximal. This radial distance increases progressively from a free end of the first portion toward the peak point and decreases progressively, more sharply, from the peak point toward a free end of the second portion.

Assuming that the cam disk 49 is turned counterclockwise in FIG. 4, as driven via the belt 23, upon termination of the sliding movement of the thermal head 38 with respect to a print paper on the platen 32 at the end of the forward stroke of the carriage 44, both the support shaft 43 and the driving pawl 47 are driven to turn clockwise reversely to the cam disk until the cam follower pin 51 sliding in the cam groove 49a reaches the peak point where the radial distance between the cam groove 49a and the axis of rotation of the cam disk 49.

As a result, the driving pawl 47 comes in contact with the slider 42 to push the same away from the platen 32 against the bias of the spring 46. Thus the slider 42 has been moved rightwardly in FIGS. 3(A) and 3(B) to a predetermined extent.

When an engaging portion 42a of the slider 42 passes the distal end 48b of the locking pawl 48 with continued movement of the slider 42, the distal end of the locking pawl 48 normally urged counterclockwise in FIG. 3(B) is inserted between the engaging portion 42a of the slider 42 and the driving pawl 47.

Therefore, the thermal head 38, movable along with the slider 42, is maintained its position spaced a predetermined distance from the print paper on the platen 32, so that the slider 42 normally urged toward the platen 32 by the spring 46 pauses on the distal end 48b of the interposed locking pawl 48. The driving pawl 47 is thereby released from the biasing force of the spring 46 so that the biasing force of the spring 46 is effectively prevented from acting on the support shaft as an unnecessary load after the thermal head 38 is moved away from the print paper on the platen.

With this arrangement, since the carriage 44 with the built-in head loading mechanism serves to assist in releasing the support shaft 43 from any unnecessary load, it is possible to return the carriage 44 to the printing start position smoothly and quickly without causing any unnecessary friction between the support shaft 43 and the driving pawl 47 after the thermal head 38 has been moved away from the print paper on the platen 32.

Although application of any necessary load of the spring 46 to the support shaft 43 can be avoided, merely pushing the engaging portion 42*a* of the slider 42 in one direction by the pivotal movement of the driving pawl 47 can eliminate the load of the spring 46 from the support shaft 43, but cannot eliminate the balance of unnecessary load between the driving pawl 47 and the slider. This is, no more application of the clockwise rotating force to the driving pawl 47 is needed after this locking.

However, merely turning the driving pawl 47 clockwise continues applying the stress on the slider 42 even after the slider 42 has been held by the locking pawl 48. This would be a cause for friction and damage between the surface of the support shaft 43 and the inner surface of a hole of the driving pawl 47.

For the other features of this invention, after the slider 42 has been pushed away from the platen 32 to the position where the locking pawl 48 is inserted, the driving pawl 47 is reversely turned to a very slight extent to release from the slider 42 completely, thereby avoiding any unnecessary load.

Consequently, in FIG. 4, after the pin 51 slides in the eccentric cam groove 49*a* beyond the peak point Rmax as the cam disk 49 is turned counterclockwise by the non-illustrated head loading mechanism, the driving pawl 47 is then returned counterclockwise by a distance between the peak point Mmax to the end of the second portion of the cam groove 49*a*. Thus, due to the eccentric cam groove 49*a*, the driving pawl 47 is turned either clockwise or counterclockwise with the peak point Rmax as the turning point, while the cam disk 49 makes a single cycle of rotation in one direction, i.e., only counterclockwise. As a result, as shown in FIG. 3(B), the cam follower pin 51 of FIG. 4 is returned to the position spaced a predetermined distance from the slider 42, upon arrival at the end of the eccentric cam groove 49*a*. The driving pawl 47 is thereby made free from any physical force so that the longitudinal movement of the slider 42 on the carriage 44 can be achieved with effective elimination of any mechanical loss of the parts.

Subsequently, when the thermal head 38 is to be brought in contact with a print paper on the platen as returned to the next point again, the individual parts take reverse movements to release the slider 42 from the locking pawl 48 so that the thermal head 38 is allowed to come in contact with the print paper on the platen under the biasing force of the spring 46.

At that time, as the driving pawl 47 is turned leftwardly (counterclockwise), the corner of the driving pawl 47 slides on the slope 48*a* of the locking pawl 48 to push the locking pawl 48 aside. Thus the locking pawl 48 is slightly turned clockwise against the counterclockwise biasing force so that its distal end 48*b* is released from the slider 42, and the released slider 42 is pushed leftwardly under the bias of the spring 46. Then when the corner of the driving pawl 47 has climbed the slope 48*a* of the locking pawl 48 all the way, the individual parts assume their postures of FIG. 3(B) again. As a result, the thermal head 38 is brought in contact with the platen 32 via the print paper 34 and the ink ribbon 36. Thus it has been prepared ready to perform a printing action.

As discussed above, according to the first embodiment of this invention, since the forward and backward movements of the carriage longitudinally of the platen and also the perpendicular movement of the thermal head toward and away from the platen are performed by one and the same drive motor, it is possible to make the apparatus simple in construction and inexpensive to manufacture. Therefore a small-sized good-performance apparatus for driving a thermal head in a thermal printer can be achieved.

According to the second embodiment of the invention, the locking mechanism is mounted on the carriage, it is possible to effectively eliminate any unnecessary load on the carriage support shaft due to the biasing force to the slider connected to the thermal head during the longitudinal movement of the carriage.

What is claimed is:

1. An apparatus for driving a thermal head in a thermal printer, comprising:

(a) a carriage for supporting the thermal head in confronting relation to a platen on which a print paper is to be supported, said carriage being movable in a forward direction along a longitudinal path parallel to the axis of the platen, with the thermal head pressed against the platen via an ink ribbon and the print paper, during forward movement for printing, and said carriage being movable in a backward direction along the longitudinal path to return to its original position, with the thermal head off the platen, during returning;

(b) a support shaft for supporting thereon said carriage in such a manner that said carriage is slidable along said support shaft longitudinally thereof;

(c) a carriage driving mechanism for driving said carriage to move on and along said support shaft in said forward and backward directions, said carriage driving mechanism including a drive motor rotatable forwardly and reversely corresponding to the forward and backward movements of said carriage, a reduction gear train operatively connected to a driving shaft of said drive motor, and a carriage feed wheel, said carriage feed wheel being composed of a lower gear having a engaging pawl and meshable with said reduction gear train for performing the forward and backward movements of said carriage, and an upper gear having a play groove engageable with said engaging pawl of said lower gear, said upper gear being pivotable coaxially of said lower gear, said upper gear being rotatable as a unit with said lower gear, with said engaging pawl being in engagement with one of opposite ends of said play groove during the forward movement and the returning of said carriage; and (d) a head loading mechanism for bringing the thermal head into and out of the platen at respective ends of the forward and backward movements of said carriage, said head loading mechanism including a pulley operatively connected to said support shaft of said carriage driving mechanism by a belt, upper and lower sector wheels each having a tooth-free portion and a toothed portion and coaxially connected to said pulley, a carriage driving idle wheel normally meshing with said lower gear of said carriage feed wheel, and upper and lower idle gears locatable in confronting relation to the respective tooth-free portions of said upper and lower sector wheels for idle rotation during the forward and backward movements of said carriage, said upper and lower idle gears being meshable with the respective toothed portions of said upper and lower sector wheels for angular movement through a predetermined angle while said engaging pawl of said lower gear slides in and along said play groove of said upper gear as said drive motor is rotated reversely when said carriage is switched over between the forward movement and the backward movement, whereby said support shaft of said carriage is angularly moved through said predetermined angle, in response to the angular movement of said upper and lower sector wheels, to bring the thermal head into and out of engagement with the print paper on said platen.

2. A thermal head driving apparatus according to claim 1, in which said toothed portion of each of said upper and lower sector wheels has a circumferential length equal to a distance by which said engaging pawl of said lower gear of said carriage feed wheel is moved idly in and along said play groove of said upper gear.

3. A thermal head driving apparatus according to claim 1, in which said head loading mechanism further includes:

a slider slidably mounted on said carriage so as to be movable perpendicularly to the sliding direction of said carriage for controlling the angular movement of the thermal head toward and away from the platen;

a first spring normally urging said slider toward the platen;

a driving pawl attached to said support shaft and slidable, with said carriage, longitudinally on said support shaft and angularly movable as a unit with said support shaft, said driving pawl being operable to move said slider away from the platen against the bias of said first spring as said support shaft is driven to rotate when said carriage is switched from the forward movement to the backward movement, and said driving pawl being also operable to allow said slider to move toward the platen under the bias of said first spring as said support shaft is driven to rotate when said carriage is switched from the backward movement to the forward movement; and a locking pawl pivotally mounted on said carriage and normally urged by a second spring to pivotally move in one direction, said locking pawl being operable to move into said driving pawl and said slider to hold said slider in a predetermined position away from the platen against the bias of said first spring as said slider is moved away from the platen to a predetermined extent by said driving pawl when said carriage is switched from the forward movement to the backward movement, and said locking pawl being operable to allow said slider to be released from said predetermined position by said driving pawl.

4. A thermal head driving apparatus according to claim 3, in which said head loading mechanism further includes a cam mechanism operatively connected to said pulley for angularly moving said support shaft through a predetermined angle in opposite directions, said cam mechanism being composed of:

a cam disk operatively connected with said pulley via an endless belt for angular movement, said cam disk having a generally C-shaped eccentric cam groove composed of a first portion and a second portion continuous with said first portion at a peak point where a varying distance between said eccentric cam groove and the center of rotation of said cam disk is maximum, said distance progressively increasing from a free end of said first portion toward said peak point and progressively decreasing from said peak point toward a free end of said second portion;

a cam follower mounted on said support shaft; and a cam follower pin fixedly secured to said cam follower and slidably received in said eccentric cam groove of said cam disk;

whereby said support shaft is rotatable so as to move said slider away from the platen as said cam follower pin slides in said eccentric cam groove of said cam disk toward said peak point when said carriage is switched from the forward movement to the backward movement, and said driving pawl being releasable from the bias of said first spring as said support shaft is rotated reversely to a predetermined extent when said cam follower pin slides in said eccentric cam groove beyond said peak point to insert said locking pawl between said driving pawl and said slider.

* * * * *